US005694725A

United States Patent [19]

Kaufman et al.

[11] Patent Number: 5,694,725

[45] Date of Patent: Dec. 9, 1997

[54] MULTISTORY MULTIUNIT BUILDING WITH MAXIMUM USABLE SPACE AND DUAL INGRESS AND EGRESS FOR UPPER FLOOR UNITS

[76] Inventors: Mark I. Kaufman; Donald J. Meeks, Jr., both of 15995 N. Barkers Landing, Houston, Tex. 77079

[21] Appl. No.: 597,925

[22] Filed: Feb. 7, 1996

[51] Int. Cl.[6] ..... E04H 1/00

[52] U.S. Cl. ..... 52/236.3; 52/234

[58] Field of Search ..... 52/236.3, 79.1, 52/79.6, 79.8, 185, 234, 236 H, 79.12, 184, 236.6, 79.7, 79.2, 79.3, 236.5, 236.1, 236.2

[56] References Cited

U.S. PATENT DOCUMENTS

| | | | |
|---|---|---|---|
| 3,552,075 | 1/1971 | Crump | 52/234 X |
| 3,623,296 | 11/1971 | Santoro | 52/79.12 |
| 3,638,379 | 2/1972 | Williams | 52/236.3 X |
| 4,098,039 | 7/1978 | Sutelan | 52/236.1 X |
| 4,315,389 | 2/1982 | Loix | 52/185 |
| 4,794,747 | 1/1989 | Yendo | 52/236.3 |
| 4,930,273 | 6/1990 | Papesch | 52/79.1 |

*Primary Examiner*—Carl D. Friedman
*Assistant Examiner*—Creighton Smith
*Attorney, Agent, or Firm*—Akin, Gump, Strauss, Hauer & Feld, L.L.P.

[57] ABSTRACT

A multistory apartment building having at least three stories and multiple apartment units. At least the third story has outside balconies extending along at least one exterior sidewall and connected to spaced apart exterior stairways between the third story and the ground to provide two pathways between each third story apartment entrance and the ground by way of the stairways. A three story, eight apartment unit per story building is disclosed by way of example. The building sidewalls each include an inset portion in such a way that a second level balcony connects the entrances of two second level apartments with at least one stairway and provides a cover or roof for two ground level apartment entrances. The third story balconies provide a cover for the second level balconies and entrances, respectively. The building roof may include portions extending over the third level balcony to provide protection for the third level entrances and the third level balconies, respectively. The particular building configuration maximizes usable space while meeting the desiderata and requirements for plural pathways between third level units and ground level.

28 Claims, 9 Drawing Sheets

MULTISTORY MULTIUNIT BUILDING WITH MAXIMUM USABLE SPACE AND DUAL INGRESS AND EGRESS FOR UPPER FLOOR UNITS

FIELD OF THE INVENTION

The present invention pertains to a multistory multiunit building having multiple ingress and egress pathways for upper story units while maximizing usable space within the building footprint.

BACKGROUND

The ever increasing cost of urban and suburban land has pressed the need for affordable, high density housing and commercial building complexes. Depending on the requirements of local building codes, a compromise must be reached with regard to the cost of the land, building structural features and the maximum usable space which can be leased or sold in the case of apartment or condominium complexes. For example, in instances when multistory, wood frame, multiunit dwelling complexes are being considered for optimizing the use of available land, while maintaining low cost of construction, consideration must be given to building code requirements with respect to ingress and egress pathways between the ground and upper level dwelling units. Many building codes require that three and four story wood frame apartment and condominium building complexes, in particular, have at least two paths of egress from each third and fourth floor occupiable unit to ground level in the event of emergency evacuation, for example. Accordingly, conventional multistory, multiple unit buildings are usually constructed with so-called breezeways or corridors which extend from one side of the building to the other. Entries to individual dwelling units open to the breezeways or corridors in such a way that an occupant of the dwelling unit may exit the building using one of at least two alternate paths which lead to stairways on opposite sides of the building. However, the breezeway or corridor arrangement reduces the usable or occupiable space available within the total area of the building footprint defined by the building outer walls. In small, as well as large, building complexes this loss of rentable or saleable space can have a material effect on the overall cost of construction and the financial return on the building owner's investment.

Accordingly, one vexatious problem in the art of design and construction of multistory, multiple unit buildings has been with regard to providing maximum, enclosable and rentable or saleable building space while providing for so-called circulation pathways which permit entry to and exit from each occupiable unit along at least two separate routes so as to minimize the risk associated with an exit path being blocked during emergency evacuation of the building. Moreover, there has also been a continuing need to provide attractive and efficient floor plans in multiple unit buildings while locating unit entrances in such a way as to provide a degree of privacy and also provide plural ingress and egress pathways. All of these desiderata are sought while minimizing construction costs and maximizing usable space over the building footprint. It is to these ends that the present invention has been developed.

SUMMARY OF THE INVENTION

The present invention provides an improved multistory multiple unit building including plural pathways of entry to and exit from each unit of one or more upper levels or floors while providing maximum usable space within the building footprint.

The present invention provides a unique multistory, particularly a three or four story, multiunit apartment building wherein at least the floor levels above the second floor level may be provided with plural entry and exit pathways to each occupiable dwelling unit while maximizing usable air conditioned space within the footprint defined by the building exterior walls. In particular, an arrangement of multiple dwelling units is provided wherein an entry to each dwelling unit on a floor above ground level opens onto an outside balcony connected to a balcony extension or catwalk interconnecting spaced apart entry and exit pathways, such as stairways.

In accordance with yet another aspect of the present invention, a multistory, particularly a three story multifamily, dwelling or apartment building is provided with a dwelling unit floorplan for each floor or level which is substantially identical to the floor plan of every other floor and wherein at least the level or levels above the second story of the building have multiple entry and exit pathways between each unit entrance door and ground level exterior of the building.

Still further, the present invention provides a unique multistory, multiple dwelling unit building having entrances for each unit opening to the building exterior with advantageous spacing between the entrances of each dwelling unit and with a unique floor plan for corner or building end dwelling units as well as for interior dwelling units. Stairways for the upper floors, such as second and third floors of the building, are advantageously spaced apart in such a way as to minimize the distance from the entrance of each dwelling unit to a stairway while also providing an alternate entry and exit path for each dwelling unit on one or more upper floors.

Those skilled in the art will further appreciate the above-mentioned advantages and superior features of the invention together with other important aspects thereof upon reading the detailed description which follows in conjunction with the drawing.

DESCRIPTION OF THE PREFERRED EMBODIMENTS

Figure 1:
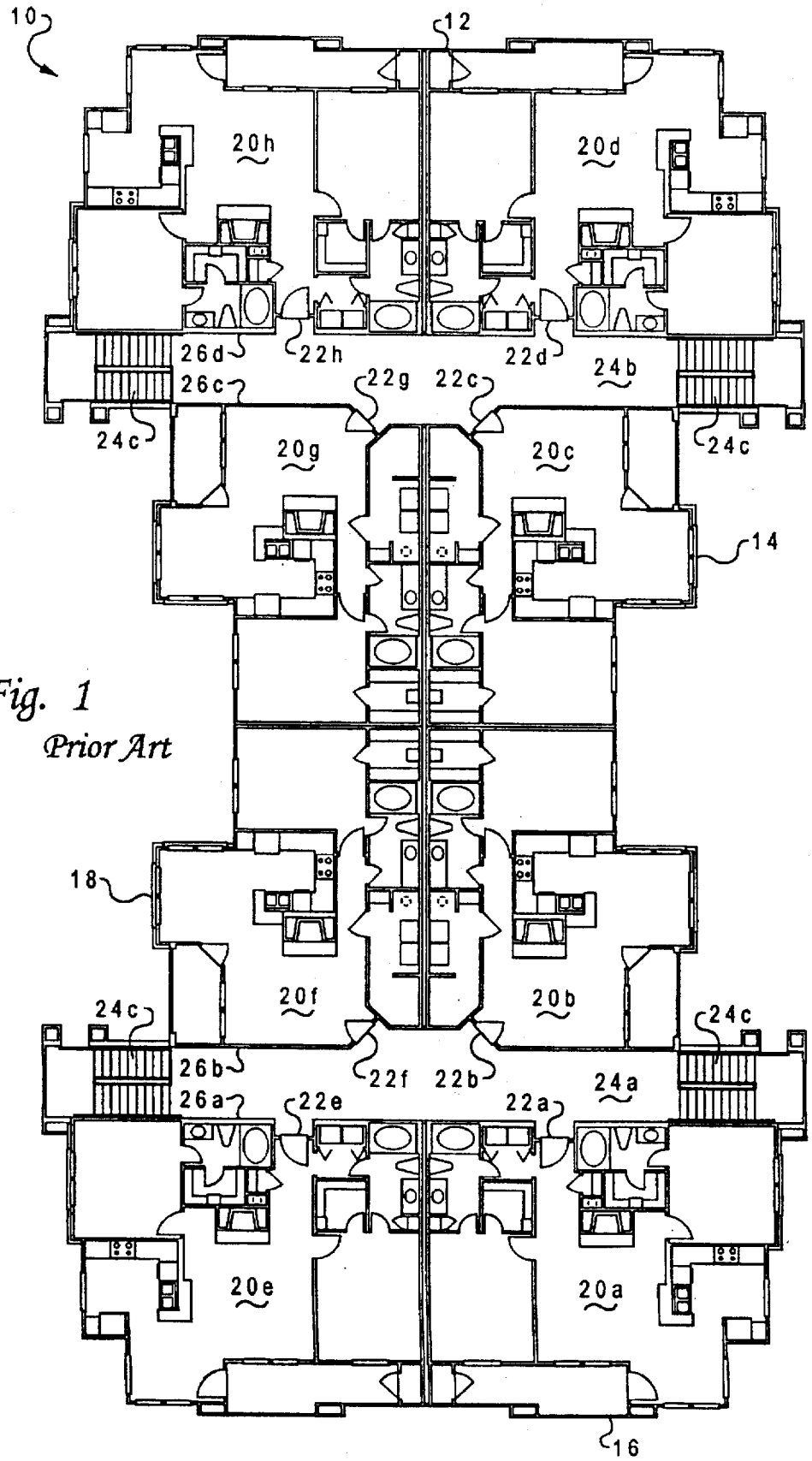
Fig. 1 Prior Art
FIG. 1 is a floor plan of a typical prior art multiple dwelling unit building having open breezeways or corridors to provide plural entry and exit paths for each occupiable building unit.

In the description which follows, like elements are marked throughout the specification and drawing with the same reference numerals, respectively. The drawing figures are not necessarily to scale and certain features of the building, particularly the floor plan outlines, are shown in generalized form in the interest of clarity and conciseness.

FIG. 1 illustrates a floor plan of a multistory multidwelling unit building, such as an apartment or condominium building, in accordance with prior art practice and generally designated by the numeral 10. The floor plan shown for the building 10 may be suitable for the ground floor but typically represents one of the upper floors of the building 10. The building 10 occupies a footprint or foundation area generally designated by the outline of the building including the exterior walls 12, 14, 16 and 18. Within the confines of the exterior walls 12, 14, 16 and 18, multiple human occupiable dwelling units are provided as illustrated and each designated by the numeral 20*a*, 20*b*, 20*c*, et cetera. Each dwelling unit has an entry 22*a*, 22*b*, 22*c*, et cetera. In order to provide plural ingress and egress pathways between the dwelling units 20*a*, 20*b*, 20*c*, et cetera, and the building exterior, such as exterior of the sidewalls 14 and 18, generally open transverse breezeways or corridors are provided and are designated by the numerals 24*a* and 24*b*, for example.

Accordingly, as shown by way of example in FIG. 1, entrances 22*a*, 22*b*, 22*e*, and 22*f* open into corridor 24*a* while entrances 22*c*, 22*d*, 22*g* and 22*h* open into corridor 24*b*. Corridors or breezeways 24*a* and 24*b* have minimum widths in accordance with local building codes, normally about six to eight feet. With such an arrangement, these corridors or breezeways are not usable or occupiable space and thus comprise an added cost of construction of the building 10 represented by the floor plan shown in FIG. 1, by way of example. Moreover, the exemplary, prior art open corridor or breezeway arrangement of FIG. 1 requires additional cost of providing exterior walls 26*a* and 26*b*, 26*c* and 26*d* which define the sides of the breezeways or corridors 24*a* and 24*b*, respectively.

It is desirable to eliminate the loss of usable space required of the transverse breezeways or corridors 24*a* and 24*b* as well as the cost of exterior wall construction, particularly on the upper floors of buildings wherein plural ingress and egress pathways with respect to each occupiable unit should or must be provided. The building 10 may, for example, have a net rentable or saleable space which is only 83% of total square footage of structure. For example, the building 10 may be a three story building having approximately 7800 square feet of rentable space per floor. However, the space required for the corridors or breezeways 24*a* and 24*b*, together with stairways 24*c*, as required for a three-story building could total about 4500 square feet thereby providing a net rentable square footage as a percentage of total square footage of only about 83%. However, the unique multistory, multiple unit building in accordance with the present invention of three stories in height and having the same rentable square footage per floor would have a net rentable square footage to gross square footage required of about 91% to 92%. In large apartment building complexes including, for example, ten to thirty or more buildings the savings in building costs can be significant.

Figure 2:
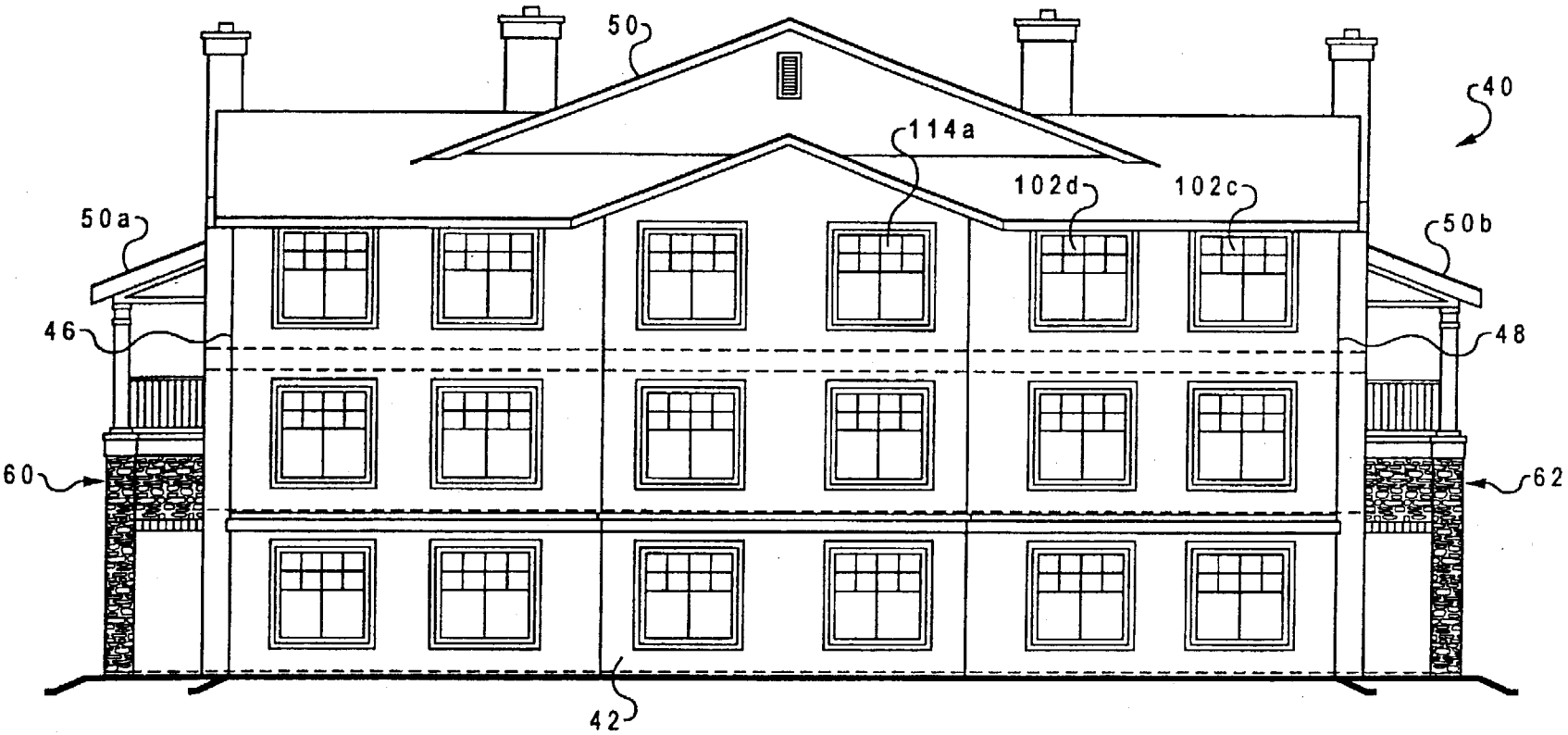
FIG. 2 is an end elevation of a three story multifamily apartment or condominium building in accordance with the invention.
Figure 3:
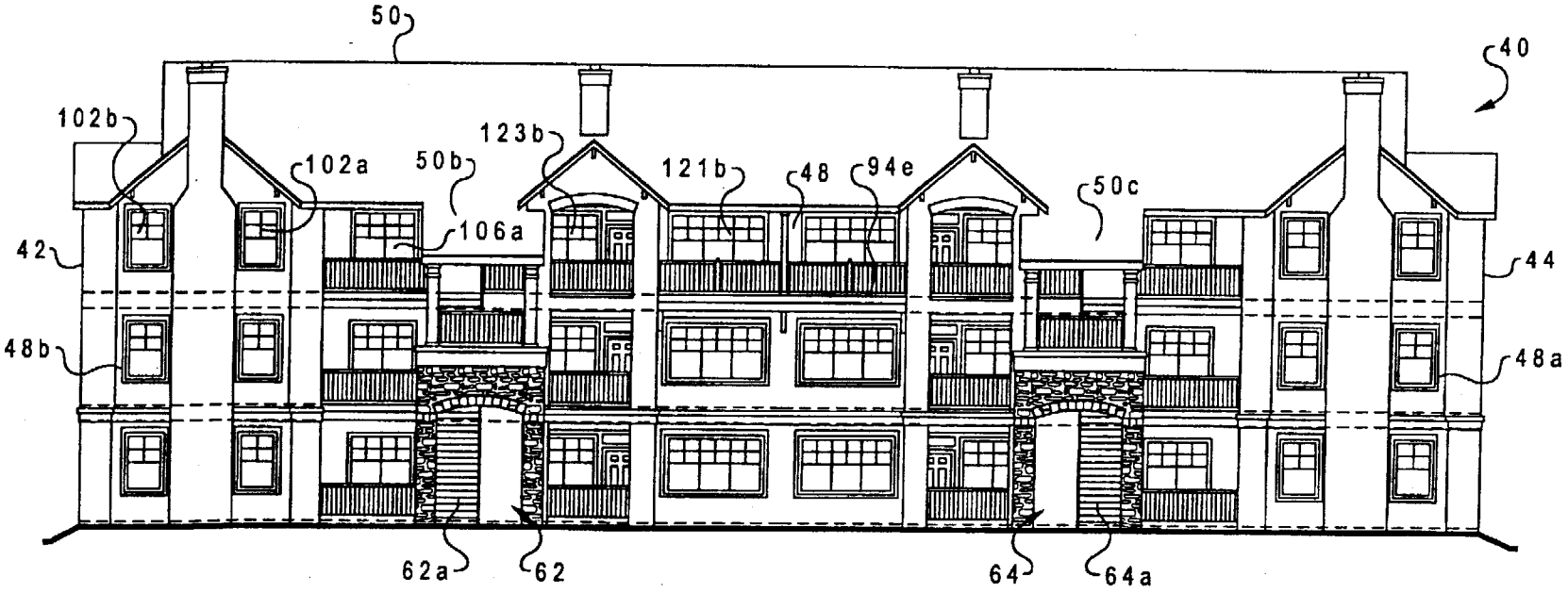
FIG. 3 is a front side elevation of the building shown in FIG. 2.
Figure 4:
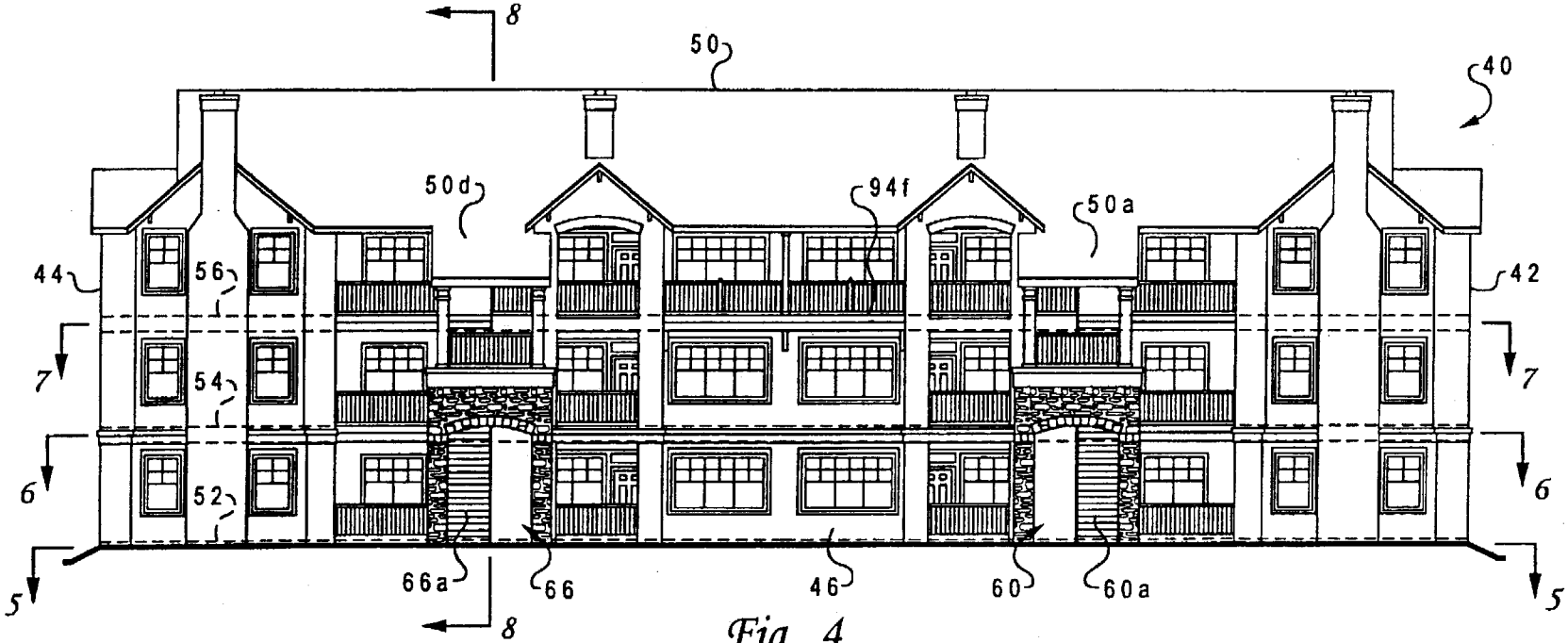
FIG. 4 is a rear side elevation of the building shown in FIGS. 2 and 3.

Referring now to FIGS. 2 through 4, the respective views show elevations of a multiunit, multistory building, particularly configured as an apartment or condominium structure and generally designated by the numeral 40. The building 40, in the exemplary embodiment of the invention shown, is a three story apartment building having opposed exterior end walls, each generally designated by numerals 42 and 44, respectively. As may be seen from the floor plans illustrated in FIGS. 5 through 7, the end walls 42 and 44 may have inset or projecting portions and are not necessarily substantially co-planar throughout their overall extent. However, such minor discontinuities in the exterior walls of the building are exemplary and various configurations of end and sidewalls which include inset or projecting bay portions for aesthetic and functional purposes may be provided while enjoying the benefits of the present invention.

The building 40 also includes opposed, generally parallel sidewalls 46 and 48 and a pitched roof 50 disposed above the walls 42, 44, 46 and 48. As indicated by the floor plans of FIGS. 5 through 7, the building 40 is of generally rectangular configuration and the sidewalls 46 and 48 may have opposed, spaced apart laterally outwardly projecting bay portions 46*a*, 46*b*, 48*a* and 48*b*, as shown. However, as mentioned previously, the walls 42, 44, 46 and 48 may also be substantially planar exterior walls.

Figure 5:
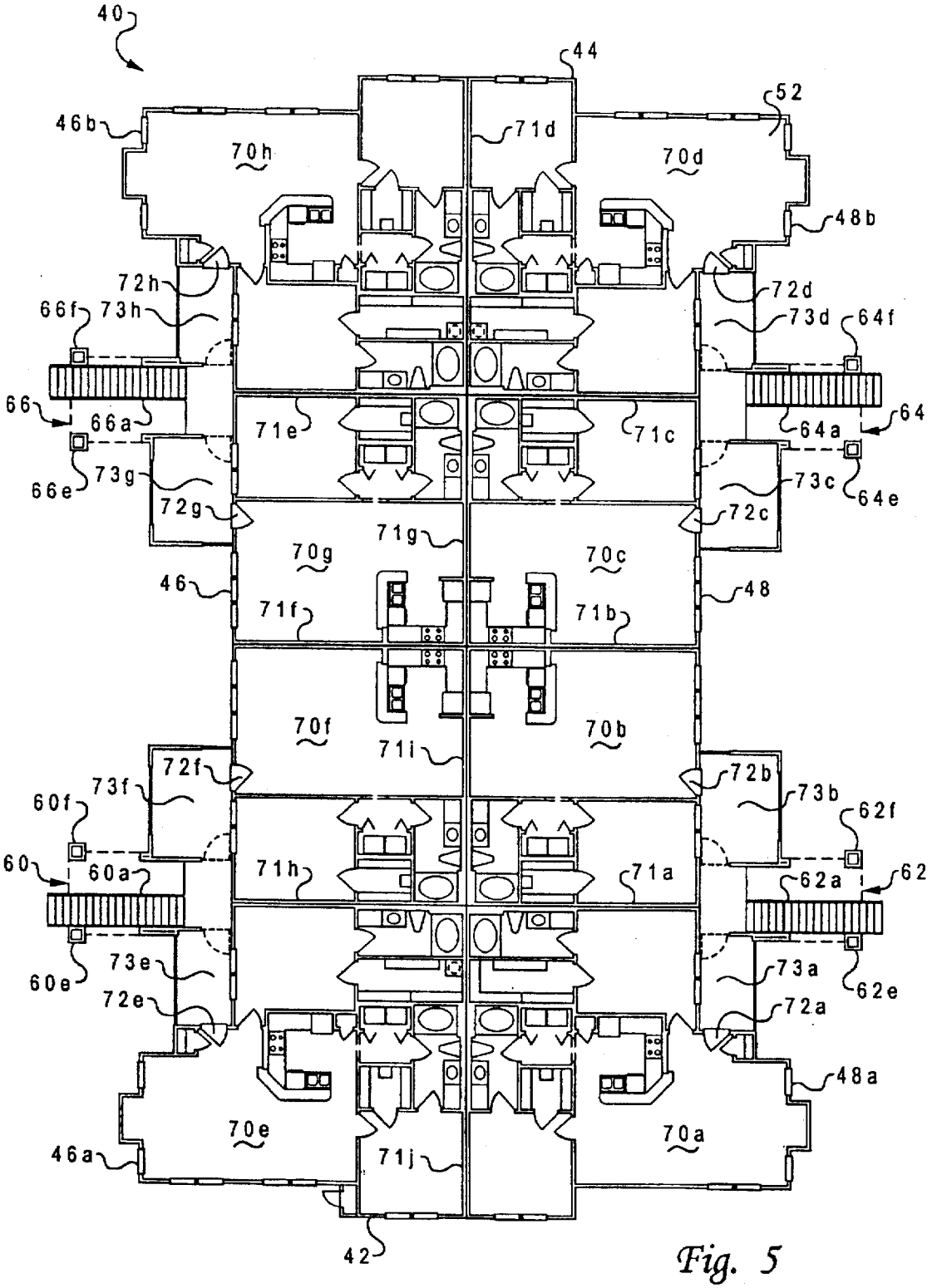
FIG. 5 is a floor plan of the first or ground level of the building taken generally from the line 5—5 of FIG. 4.
Figure 6:
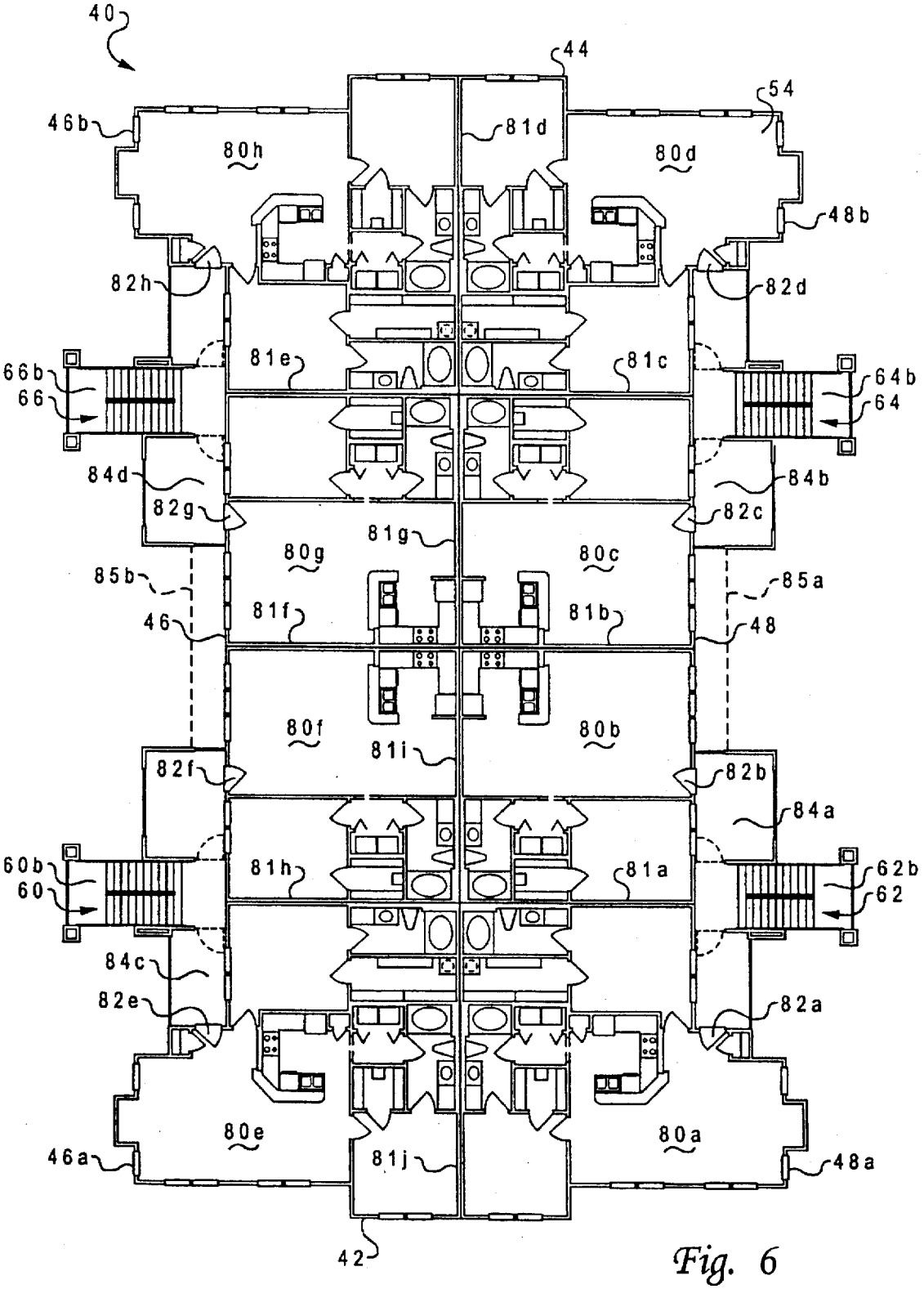
FIG. 6 is a floor plan of the second story of the building taken generally from the line 6—6 of FIG. 4.
Figure 7:
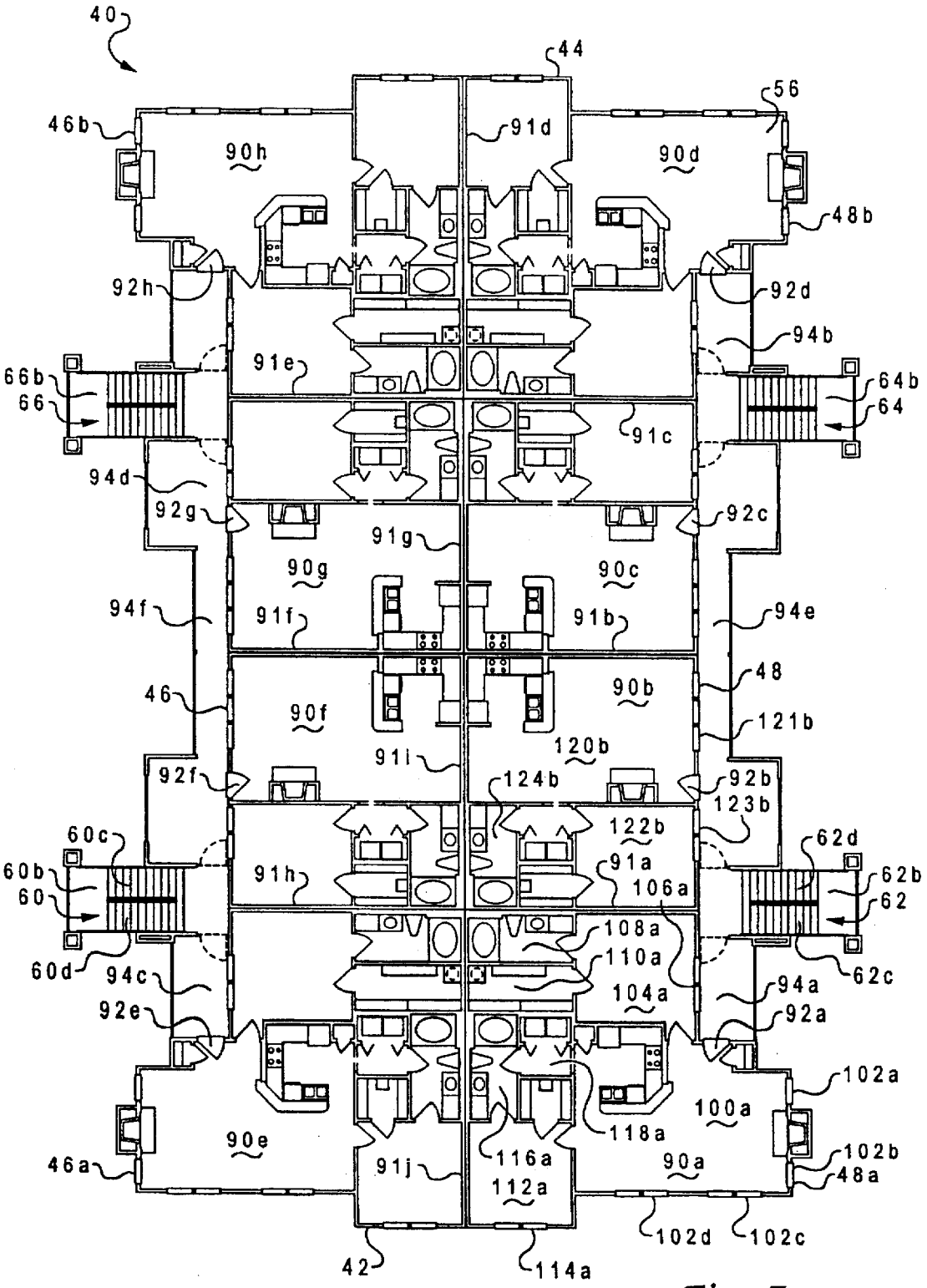
FIG. 7 is a floor plan of the third story of the building taken generally from the line 7—7 of FIG. 4.

Referring briefly to FIG. 4, the building 40 is configured as a three story structure having a first or so-called ground floor or level 52, a second floor or level 54 and a third floor or level 56. Each floor or level 52, 54 and 56 may have substantially the same floor plan as indicated by FIGS. 5, 6 and 7. However, the interior partitions or walls of each occupiable unit of the building on each level may be somewhat different from that shown while benefiting from the unique features of the invention.

Referring again to FIGS. 2 through 4, the building 40 is provided with spaced apart and opposed, partially enclosed vertical pathway portions comprising stairways 60, 62, 64 and 66. The stairways 60, 62, 64 and 66 may also comprise mechanical elevators, for example. Stairways 62 and 64 are disposed adjacent the sidewall 48 and stairways 60 and 66 are disposed adjacent the sidewall 46. The stairways 60, 62, 64, and 66 may, if desired, also be disposed at the corners of building 40, closer together along sidewalls 46 and 48, or even adjacent the end walls 42 and 44. However, the stairways on each side of a building such as stairways 62 and 64 may require to be spaced apart a distance at least one half the distance from one corner of building 40 to the opposite corner along a diagonal. A preferred arrangement is shown for the particular floor plan of building 40.

Referring now to FIG. 5, the first level 52 of building 40 is divided into plural dwelling or otherwise human occupiable units, generally designated by the numerals 70*a*, 70*b*, 70*c*, 70*d*, 70*e*, 70*f*, 70*g* and 70*h*. A cluster comprising units 70*a*, 70*b*, 70*f* and 70*e* are substantially mirror images of a cluster comprising units 70*c*, 70*d*, 70*g* and 70*h*. As illustrated in FIG. 5, units 70*a* and 70*b* have entrances 72*a* and 72*b*, respectively, while units 70*c* and 70*d* have entrances 72*c* and 72*d*. In like manner, units 70*d*, 70*f*, 70*g* and 70*h* have respective entrances 72*e*, 72*f*, 72*g* and 72*h*. The ground level entrances for level 52 are paired in such a way as to be disposed relatively close to the respective stairways 60, 62, 64 and 66, although such an arrangement of the unit entrances at level 52 are not necessary in accordance with the invention. The placement of the unit entrances for level 52 provides partial cover for the respective entrances due to the balcony structures to be described herein and which are provided over these entries by the arrangement of levels 54 and 56. As further shown in FIG. 5, each of the aforementioned dwelling units 70*a* through 70*h* are divided by respective common interior walls 71*a*, 71*b*, 71*c*, 71*d*, 71*e*, 71*f*, 71*g*, 71*h*, 71*i* and 71*j* so that essentially all of the space within the confines of the exterior walls 42, 44, 46 and 48 is usable space.

Referring now to FIG. 6, the second level or story 54 is illustrated in plan view and may, as shown by way of example, have a substantially identical floor plan as the ground level 52. Each dwelling or occupiable unit in level 54 is indicated by numerals 80*a* through 8O*h*, respectively. The second story units are separated by common walls 81*a* through 81*j* and have respective entrances 82*a* through 82*h*. As shown by way of example, a pair of living units such as 80*a* and 80*b* have their entrances 82*a* and 82*b* opening onto a common balcony 84*a* which has access to stairway 62. In like manner, living units 80*c* and 80*d* have their entrances 82*c* and 82*d* opening onto a common balcony 84*b* which has access to stairway 64. Still further, balconies 84*c* and 84*d* provide access to entrances 82*e* and 82*f* by way of stairway 60 and to entrances 82*g* and 82*h* by way of stairway 66, respectively. Moreover, the balconies 84*a* through 84*d* provide protection for the entrances 72*a* through 72*h* of level 52, see FIG. 8 by way of example, and, in essence, form roofs over entrance walkways and patio spaces 73*a* through 73*h*, for selected ones of the units 70*a* through 70*h*, as illustrated in FIG. 5.

Referring now to FIG. 7, the third level or story 56 is shown in plan view and includes living or occupiable units 90*a* through 90*h* having essentially the same floor plans as the units 70*a* through 70*h* and 80*a* through 80*h* and divided by interior walls 91*a* through 91*j*. The units 90*a* through 90*h* have respective entrances 92*a* through 92*h*. The entrances 92*a* and 92*b* are normally served by the stairway 62 which provides access to ground level from units 90*a* and 90*b*. In like manner, the entrances 92*c* and 92*d* are normally served by stairway 64 which provides ground level access from the units associated therewith. Still further, entrances 92*e* and 92*f* are normally served by stairway 60 while entrances 92*g* and 92*h* are normally served by stairway 66, each stairway providing ground level access from the units nearest thereto, respectively.

Entrances 92*a* and 92*b* open onto a balcony 94*a* contiguous with stairway 62 and providing a roof over balcony 84*a*. In like manner, entrances 92*c* and 92*d* open onto a balcony 94*b* contiguous with stairway 64 and providing a roof over balcony 84*b*. Balcony 94*c* provides a pathway between entrances 92*e* and 92*f* and stairway 60 and balcony 94*d* provides a pathway between stairway 66 and entrances 92*g* and 92*h*. Balconies 94*c* and 94*d*, of course, provide a roof or cover over balconies 84*c* and 84*d*. The third story or level 56, in accordance with most code requirements, and as a practical consideration, is provided with an alternate route of egress and ingress between lower level 54 and ground level and each unit entrance 92*a* through 92*h*. Balcony or catwalk sections 94*e* and 94*f* are provided and suitably supported on opposite building sides 48 and 46, respectively, of building 40. Balcony section 94*e* interconnects balconies 94*a* and 94*b* while balcony 94*f* interconnects balconies 94*c* and 94*d*. Balcony section 94*e* provides an alternate pathway of ingress and egress for each of the living units 90*a* through 90*d* since units 90*a* and 90*b* may be accessed or exited through stairway 64 as well as stairway 62, and units 90*c* and 90*d* may be entered or exited through stairway 62 as well as stairway 64. Similar alternate pathways are provided for units 90*e*, 90*f*, 90*g* and 90*h* via stairways 60 and 66 as will be appreciated from viewing FIG. 7.

Figure 8:
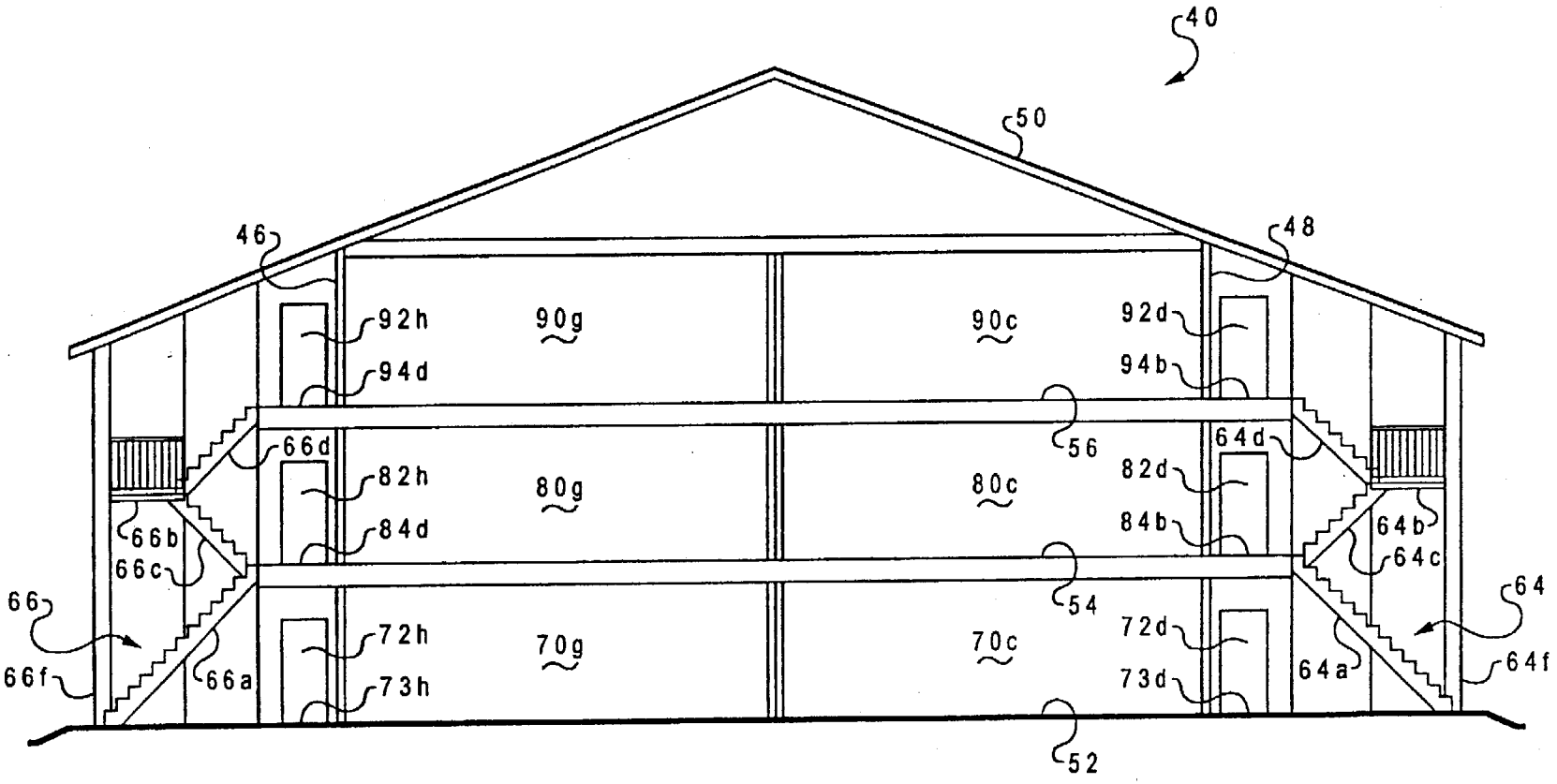
FIG. 8 is a section view taken generally from line 8—8 of FIG. 4.

Each of the stairways 60, 62, 64 and 66 has a first flight of stairs leading from ground level 52 to the respective balconies 84*a* through 84*d*. As shown in FIG. 8, for example, stairway 64 has a first flight of stairs 64*a* leading to balcony 84*b*. Stairway 64 also has a landing 64*b* intermediate the levels 54 and 56 interconnecting balcony 84*b* with balcony 94*b* by way of stair flights 64*c* and 64*d*. As further shown in FIG. 8, stairway 66 also has stair flights 66*a*, 66*c* and 66*d* as well as a landing 66*b* providing a pathway between balcony 94*d* and balcony 84*d* as well as ground level. Viewing FIGS. 3, 4 and 7, it will be appreciated that the stairways 60 and 62 have substantially identical configurations of landings and stair flights appropriately indicated by corresponding reference numerals 60*a* through 60*d* and 62*a* through 62*d*. Appropriate support columns 60*e* and 60*f*, for example, are part of the stairway structure 60 and support the landing 60*b*. Corresponding columns for the stairways 62, 64 and 66 are appropriately numbered with the suffixes "e" and "f" for each of the stairways and support the respective landings of each stairway also.

As shown in FIGS. 2 through 4 and 8, the roof 50 may be extended at roof sections 50*a*, 50*b*, 50*c* and 50*d* to cover the stairways 62, 64, 60 and 66, respectively. Moreover, as shown by way of example in FIG. 8, the roof 50 also extends over the balconies 94*a* through 94*f* at level 56 to provide a covering for these unit ingress and egress pathways also. Thanks to the bays 46*a*, 46*b*, 48*a* and 48*b*, the roofline is extended to cover at least all of the width of the balconies 94*a* through 94*f*. Balconies 84*a* through 84*d* have additional covering due to the balconies 94*a* through 94*f*. Still further, the unit entrances on level 52 are thus protected not only by the lateral extent of the roof sections but also the balconies 84*a* through 84*d*. Moreover, viewing FIG. 6, a connecting balcony or catwalk 85*a* and 85*b* may be provided at the second floor or level of building 40 and interconnecting balconies 84*a* with 84*b* and balcony 84*c* with balcony 84*d*, respectively.

The building 40 also provides a unique floor plan for the multiple dwelling units 90*a*, 90*b*, 90*c*, 90*d*, 90*e*, 90*f*, 90*g* and 90*h* in particular, the floor plan is repeated, as indicated, for each corner quadrant of the building and is made up of two separate dwelling units, such as units 90*a* and 90*b*, for example. Dwelling unit 90*a* includes entry 92*a* into a combined living, dining and kitchen room 100*a* and having exterior walls with requisite window area, such as indicated by numerals 102*a*, 102*b*, 102*c* and 102*d*. A first bedroom or study opens off of room 100*a* and is designated by numeral 104*a*. Room 104*a* has exterior window area 106*a*. Lavatory room 108*a* and closet 110*a* open off of room 104*a*. A second bedroom or study 112*a* opens off of room 100*a* and includes window area 114*a* and interior lavatory rooms 116*a* and closet 118*a*. Accordingly, a dwelling unit is provided in a corner of a generally rectangular building such as building 40 which has a living room and two bedrooms or a bedroom and a study, all having the desired and requisite exterior window area. Still further, the building 40 provides, on each floor, a second dwelling unit in each quadrant, such as dwelling unit 90*b*, having a combined living, dining and kitchen room 120*b* and a bedroom 122*b* which opens off of room 120*b* together with a lavatory 124*b*. Both room 120*b* and 122*b* have exterior windows 121*b* and 123*b*, respectively. Those skilled in the art will appreciate from viewing FIGS. 5 through 7 that this unique floor plan is easily repeated for each quadrant of the building on each floor while providing advantageous arrangements of the rooms of each dwelling unit.

The building 40 is exemplary of a multiple occupiable unit building of multistory configuration wherein at the third level or story dual ingress and egress pathways are provided for each unit entrance without the added cost of construction required by the prior art breezeway concepts interconnecting opposite sides of the building. Although the exemplary configuration of the building 40 shows eight occupiable units on each level, a building in accordance with the present invention may be constructed having greater than eight units per level or fewer than eight units per level. However, the concept of exterior balconies on the third level (or the second level above the ground level) satisfies the practical and required provision of multiple pathways for each unit while minimizing construction costs and unrentable or unsaleable space within the building footprint.

Where regulatory requirements and other considerations permit, buildings of four or more stories may also be constructed in accordance with the invention wherein all levels or floors including the second story and above may also be arranged in accordance with the floor plan of FIG. 7, for example. Balcony sections similar to the balcony sections 94e and 94f may thus provide alternate ingress and egress pathways for each unit entrance at the respective levels. The interconnected exterior balconies 94a, 94e and 94b as well as the interconnected balconies 94c, 94f and 94d, may be provided at a third level or higher and the exterior stairways may extend down only to the second level 54, for example, and wherein the second level then provides a separate pathway to ground level. In other words, as long as multiple pathways from the third floor or level and higher are provided to at least the second level, emergency evacuation to a level which will provide suitable escape from the building can be provided.

Figure 9:
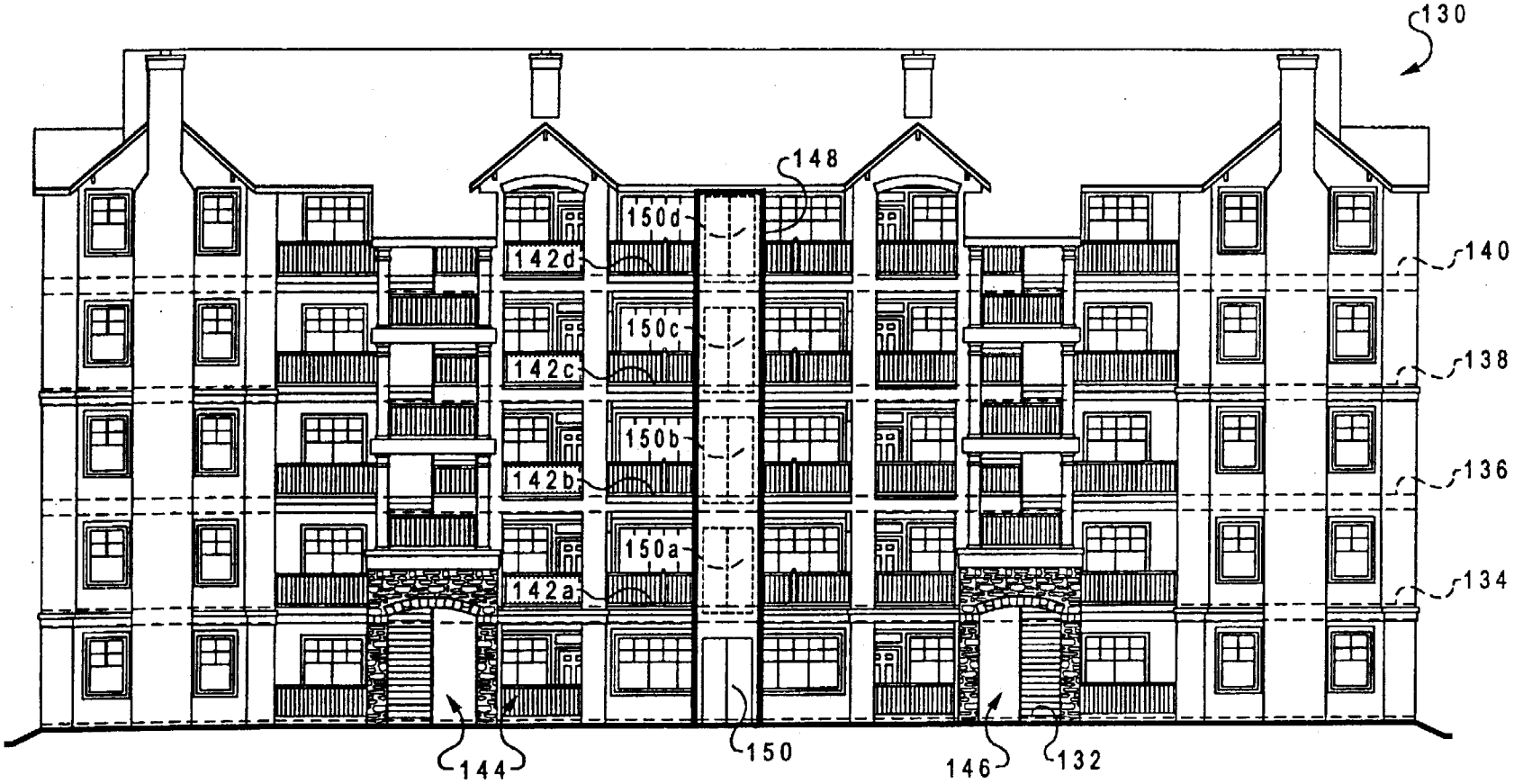
FIG. 9 is a side elevation of an alternate embodiment of the present invention.

Referring now to FIG. 9, an alternate embodiment of a multistory, multiunit building is illustrated and generally designated by the numeral 130. The building 130 is similar to the building 40 except that the building 130 is characterized by five vertically spaced floors including a floor or level 132, a second floor 134, a third floor 136, a fourth floor 138 and a fifth floor 140. Each of the floors or levels 132, 134, 136, 138 and 140 may have a floor plan similar to that shown in FIGS. 5 through 7 and each floor above the ground level floor 132 may have balcony means 142a, 142b, 142c and 142d disposed between respective stairways 144 and 146. The stairways 144 and 146 correspond to any one of the stairways 60, 62, 64 and 66 of the building 40 except that the stairways 144 and 146 include flights of stairs interconnecting each adjacent floor in building 130. Since building 130 includes multiple floors which may be inconvenient to access by way of the stairways 144 and 146 alone, an elevator enclosure 148 is disposed between stairways 144 and 146 and includes door means at each balcony 142a through 142d to provide access between ground level and any one of floors 134, 136, 138 and 140. The elevator enclosure 148 has a door 150 at ground level and doors 150a, 150b, 150c and 150d at each balcony 142a through 142d. Suitable elevator means, not shown, may be disposed within the enclosure 148 for traversing between each floor and ground level. The arrangement of balconies and elevator enclosure described above may be duplicated on the opposite side of building 130. Those skilled in the art will recognize that a building such as described herein may have additional vertically stacked floors or levels with spaced apart stairways such as the stairways 144 and 146 extending to all levels and an elevator enclosure, such as the elevator enclosure 148 also extending to all levels.

As mentioned above, the buildings 40 and 130 are exemplary of the inventive concept with respect to a multistory, multi-occupiable unit type building, such as an apartment or condominium building, which maximizes the usable space within the building footprint while providing for multiple pathways between individual units, particularly on levels of the building above ground. A building in accordance with the present invention, may be constructed utilizing conventional materials and engineering while incorporating the advantageous features of the invention as described and shown.

Although a preferred and exemplary embodiment of the invention has been described in detail, those skilled in the art will recognize that various substitutions and modifications may be made to the building 40 without departing from the scope and spirit of the invention as recited in the appended claims.

What is claimed is:

1. A multistory building comprising:

exterior wall means defining an enclosable space;

a first ground level story, a second story above said ground level story and a third story above said second story;

plural spaced apart occupiable units on said third story and within said enclosable space, each of said units having an entrance opening to said exterior wall means;

means forming plural spaced apart pathways extending generally between said third story and at least one of a lower story and ground level; and a balcony extending along said exterior wall means exterior of said enclosable space and disposed such that each of said entrances opens onto said balcony, said balcony forming a connecting pathway between each of said entrances and said plural spaced apart pathways between said third story and said at least one of said lower story and ground level.

2. The building set forth in claim 1 wherein:

said exterior wall means comprises two opposed end walls and two opposed sidewalls and said plural pathways between said third story and said one of said lower story and ground level comprise spaced apart stairways disposed adjacent one of said walls.

3. The building set forth in claim 2 including:

means forming access from at least one of said stairways to at least one interior space forming an occupiable unit on said second story.

4. The building set forth in claim 3 wherein:

said building includes at least three occupiable units at said third story, each of said units at said third story having an entrance opening onto said balcony for ingress to and egress from said units at said third story, respectively, by way of said plural spaced apart pathways between said third story and one of said lower story and ground level.

5. The building set forth in claim 4 wherein:

at least said third story has four occupiable units spaced apart and separate from each other within said exterior wall means, each of said occupiable units of said four including an entrance opening onto said balcony providing a pathway between each of said entrances, respectively, and said pathways between said third story and one of said lower story said ground level.

6. The building set forth in claim 5 wherein:

each of said four entrances opens onto a balcony extending along one sidewall of said building.

7. The building set forth in claim 6 wherein:

said building includes at least eight occupiable units disposed at said third story, a balcony extending along one sidewall, a balcony extending along an opposite sidewall, four of said units having entrances opening onto one of said balconies and four of said units having entrances opening onto the other of said balconies, each of said balconies being connected to means forming spaced apart generally vertical pathways between said third story and one of said lower story and ground level.

8. The building set forth in claim 2 wherein:

at least said one sidewall includes an inset sidewall part interconnecting two outwardly projecting bay parts; and said building includes a roof having a portion extending beyond said one sidewall and forming a cover over said balcony of said third story, and each of said entrances for said units at said third story open onto said balcony under said roof.

9. The building set forth in claim 1 wherein:

said spaced apart pathways between said third story and said one of said lower story and ground level comprise stairways, respectively.

10. The building set forth in claim 9 wherein:

said stairways open onto a balcony disposed at said second story, said balcony at said second story providing ingress to plural entrances for respective plural units of said building at said second story.

11. The building set forth in claim 1 wherein:

one of said units is disposed at an intersection of a sidewall and an end wall of said building and said one unit includes a kitchen, dining and living room having window means opening to said sidewall and end wall, a first room opening off of said living room and having window means in said sidewall and a second room opening off of said living room and having window means in said end wall.

12. The building set forth in claim 11 wherein:

a second unit has an entrance opening to said balcony and includes a kitchen, dining and living room having window means opening to said sidewall and a first room opening off of said living room of said second unit and having window means opening to said sidewall, said second unit having common wall means with said one unit.

13. The building set forth in claim 12 wherein:

said one unit and said second unit are repeated at each corner of said building to provide a total of eight units on said third story.

14. The building set forth in claim 13 wherein:

said units of said third story are repeated at said first story and said second story.

15. The building set forth in claim 1 including:

elevator means interposed between said means forming plural spaced apart pathways, said elevator means opening onto said balcony at each story of said building.

16. A multistory, multiunit apartment building comprising:

opposed exterior sidewalls, opposed exterior end walls and a roof defining an enclosed space;

a ground level of said building including interior wall means dividing said ground level into plural apartment units within said space, each of said apartment units on said ground level having an entrance;

a second level directly above said ground level having interior wall means dividing said second level into plural apartment units on said second level within said space;

a third level of said building disposed above said second level and interior wall means dividing said third level into plural apartment units on said third level within said space, each of said apartment units on said third level having an entrance opening to at least one of said sidewalls;

spaced apart stairways adjacent to said at least one sidewall and exterior of said space; and a third level balcony extending along said at least one sidewall exterior of said space and providing a pathway between each of said entrances of said apartment units on said third level and each of said stairways, respectively.

17. The building set forth in claim 16 wherein:

said third level includes plural apartment units each having an entrance opening to one of said opposed sidewalls, and said third level includes plural apartment units each having an entrance opening to the other of said opposed sidewalls, respectively, both of said opposed sidewalls includes a third level balcony, and said spaced apart stairways disposed adjacent each of said opposed sidewalls and interconnecting the entrances of each unit along one sidewall with each stairway along said one sidewall to provide plural pathways between each unit and at least one of a lower level and said ground level by way of said stairways, respectively.

18. The building set forth in claim 17 wherein:

each of said apartment units on said second level have an entrance opening to a second level balcony along at least one of said sidewalls, said second level balcony being connected to at least one of said stairways.

19. The building set forth in claim 18 wherein:

said second level balcony is disposed directly above at least one entrance to an apartment unit on said ground level.

20. The building set forth in claim 18 wherein:

at least one third level balcony is disposed above and forms a roof over the second level balcony.

21. The building set forth in claim 18 wherein:

at least two apartment units on said ground level have entrances opening onto a walkway under said second level balcony.

22. The building set forth in claim 21 wherein:

at least two apartment units on said second level open onto said second level balcony under at least a portion of said third level balcony and adjacent said stairway.

23. The building set forth in claim 22 wherein:

at least two apartment units on said third level have entrances opening onto a portion of said third level balcony adjacent to one of said stairways.

24. The building set forth in claim 16 wherein:

said spaced apart stairways include a first flight of stairs interconnecting said ground level with a second level balcony connected to at least one entrance to one of said apartment units on said second level, a second flight of stairs interconnecting said second level balcony with a landing; and a third flight of stairs interconnecting said landing with said third level balcony.

25. A multistory, multiunit building comprising:

opposed exterior sidewalls, opposed exterior end walls and a roof defining an enclosed space;

a ground level of said building forming at least one occupiable unit within said space;

a second level of said building generally above said ground level and forming at least one occupiable unit within said space;

a third level of said building disposed generally above said second level and including interior wall means dividing said third level into plural occupiable units on said third level within said space, each of said occupiable units of said third level having an entrance opening to at least one of said sidewalls;

spaced apart stairways exterior of at least one of said sidewalls and extending from ground level to said third level; and a third level balcony extending along and exterior of at least one of said sidewalls and providing a pathway between each of said entrances of said units on said third level and each of said stairways, respectively, to provide for emergency egress from each of said units on said third level to the ground.

26. The building set forth in claim 25 including:

said spaced apart stairways exterior of both of said sidewalls; and a third level balcony extending along and exterior of each of said sidewalls and interconnecting said stairways exterior of each of said sidewalls, respectively.

27. A multiunit apartment building of at least three stories in height comprising:

opposed exterior sidewalls, opposed exterior end walls and a roof defining an enclosed space;

a ground level of said building including interior wall means partitioning said ground level into plural apartment units within said space, each of said apartment units on said ground level having an entrance opening to one of said sidewalls;

a second level of said building directly above said ground level having interior wall means partitioning said second level into plural apartment units on said second level within said space, each of said apartment units on said second level having an entrance opening to said one sidewall;

a third level of said building directly above said second level and having interior wall means partitioning said third level into plural apartment units on said third level within said space, each of said apartment units on said third level having an entrance opening to said one sidewall;

spaced apart stairways adjacent to said one sidewall extending between said third level and the ground adjacent to and exterior of said building;

spaced apart balconies on said second level exterior of said space interconnecting each of said stairways with an entrance to at least one apartment unit on said second level, respectively;

a third level balcony extending along said one sidewall exterior of said space and adjacent to each of said stairways, respectively, and connecting an entrance to at least one apartment on said third level with one of said stairways; and a balcony section at said third level exterior of said space and connecting each of said balconies on said third level to each other to provide plural pathways between each entrance of each apartment unit on said third level to the ground by way of said stairways, respectively.

28. The building set forth in claim 27 wherein:

said third level includes at least four apartment units having entrances opening to one of said sidewalls and four apartment units having entrances opening to the other of said sidewalls, each of two apartment units on a sidewall having the balcony adjacent to an entrance to said apartment units, respectively, and said balcony sections along each of said sidewalls interconnecting spaced apart balconies for entrances to a pair of apartment units; and said spaced apart stairways being adjacent both of said sidewalls and connected to each balcony at said third level to provide at least two pathways between said ground level and an entrance to a third level apartment unit.

* * * * *